United States Patent [19]

Gartzke

[11] Patent Number: 4,737,601

[45] Date of Patent: Apr. 12, 1988

[54] HERMETICALLY SEALED ELECTRICAL FEEDTHROUGH AND METHOD OF MAKING SAME

[75] Inventor: Donald G. Gartzke, Hamilton, Mass.

[73] Assignee: Dynawave Incorporated, Georgetown, Mass.

[21] Appl. No.: 897,654

[22] Filed: Aug. 18, 1986

[51] Int. Cl.[4] ..... H01B 17/26

[52] U.S. Cl. ..... 174/152 GM; 29/857; 174/50.55; 439/578; 439/886; 439/887

[58] Field of Search ..... 174/50.55, 50.56, 50.61, 174/75 C, 152 R, 152 GM; 29/857, 860; 339/94 C, 126 R, 126 J, 177 R, 177 E, 278 C; 439/550, 559, 562, 566, 572, 578, 886, 887, 908

[56] References Cited

U.S. PATENT DOCUMENTS

| | | | |
|---|---|---|---|
| 2,632,863 | 3/1953 | Norton | 174/50.55 X |
| 3,209,103 | 9/1965 | Klammer | 174/50.56 X |
| 3,927,841 | 12/1975 | Iacobucci | 339/278 C |

*Primary Examiner*—Laramie E. Askin

*Attorney, Agent, or Firm*—John E. Toupal; Harold G. Jarcho

[57] ABSTRACT

An hermetically sealed electrical feedthrough assembly including an elongated inner electrical conductor having first and second ends; a glass body hermetically sealed around one length portion of the inner conductor adjacent to the first end thereof; a metal adapter hermetically sealed around the glass body and adapted for mounting in a wall of a housing; a tubular outer electrical conductor enclosing and coaxial with another length portion of the inner electrical conductor, the outer electrical conductor being separated from the inner electrical conductor by an annular volume and having one end portion electrically connected to the metal adapter and an opposite end portion disposed adjacent to the second end of the inner electrical conductor; and electrical insulation filling the annular volume and electrically isolating the outer electrical conductor from the another length portion of the inner electrical conductor.

26 Claims, 1 Drawing Sheet

HERMETICALLY SEALED ELECTRICAL FEEDTHROUGH AND METHOD OF MAKING SAME

BACKGROUND OF THE INVENTION

This invention relates generally to electrical feedthroughs and, more particularly, to an hermetically sealed coaxial cable feedthrough.

Hermetically-sealed casings are used extensively to package a variety of hybrid microcircuits. Typically, glass-to-metal seals are employed to hermetically seal and electrically isolate one or more lead wires from a package body. Generally, the hermetic seal is produced by fusing glass between the lead wire and the package body. Such hybrid packages provide, for microelectronic circuits, enclosures that are electrically accessible but completely isolated from external hostile environments.

Significant problems encountered during the creation of hermetically sealed packages stem from requirements for internal circuitry routing. The use of either elongated pin feedthroughs or gold ribbons to reach internal circuitry often results in impedance mismatches. Conversely, the interconnection of internal circuitry and feedthrough pins with coaxial cable assemblies entails sensitive soldering procedures that can damage individual components, particularly the fragile inner conductors of the cable assemblies.

The object of this invention, therefore, is to provide an improved feedthrough for hermetically sealed packages.

SUMMARY OF THE INVENTION

The invention is an hermetically sealed electrical feedthrough assembly including an elongated inner electrical conductor having first and second ends; a glass body hermetically sealed around one length portion of the inner conductor adjacent to the first end thereof; a metal adapter hermetically sealed around the glass body and adapted for mounting in a wall of a housing; a tubular outer electrical conductor enclosing and coaxial with another length portion of the inner electrical conductor, the outer electrical conductor being separated from the inner electrical conductor by an annular volume and having one end portion electrically connected to the metal adapter and an opposite end portion disposed adjacent to the second end of the inner electrical conductor; and electrical insulation filling the annular volume and electrically isolating the outer electrical conductor from the another length portion of the inner electrical conductor. High performance interconnections with microcircuitry in an hermetically sealed housing is facilitated by the disclosed assembly.

According to specific features of the invention, the adapter defines an outer cylindrical cavity extending inwardly from an outer end thereof and an inner cylindrical cavity extending inwardly from an inner end thereof and coaxially aligned with the outer cylindrical cavity, the outer cylindrical cavity retaining the glass body, and the inner cylindrical cavity retaining an end section of the outer electrical conductor. These features provide the desired assembly in a structurally efficient arrangement.

According to another feature of the invention, the adapter defines a circumferential flange with an annular surface for engaging the wall of the housing, the annular surface facing toward the inner end. The circumferential flange accommodates mounting of the assembly in the hermetically sealed housing.

According to still other features of the invention, the inner and outer cylindrical cavities are separated by a central cavity defined by an annular rib having an inner surface facing the inner cylindrical cavity and an outer surface facing the outer cylindrical cavity, the inner surface engages the outer electrical conductor, the outer surface engages said glass body, the diameter of the inner cylindrical cavity is less than the diameter of the outer cylindrical cavity, and the another length portion of the inner electrical conductor extends between the second end thereof and the central cavity.

According to yet other features of the invention, the inner electrical conductor and the adapter are made of stainless steel and plated with an alloy comprising nickel and gold, and the outer electrical conductor is made of a ductile, electrically conductive material. The disclosed conductor and adapter materials facilitate both hermetic sealing and soldering operations while the ductile outer conductor is easily manipulated during interconnection procedures.

The invention further includes a method for producing an hermetically sealed cable assembly and constituted by the steps of providing a cylindrical glass body with an axial passage; providing a metal adapter with a cylindrical cavity conforming to the glass body; providing an elongated inner electrical conductor; providing an elongated, tubular outer electrical conductor having an inner surface engaged by an elongated cylindrical insulator defining a central passage coaxially aligned with the outer electrical conductor and conforming in shape to the inner electrical conductor; inserting one length portion of the inner electrical conductor into the axial passage; inserting the glass body into the outer cylindrical cavity; applying heat so as to produce a hermetic seal between the glass body and both the adapter and the one length portion of the inner electrical conductor; pressing another length portion of the inner electrical conductor into the central passage; and electrically connecting the outer electrical conductor to the adapter. This method provides the desired assembly in a simple, efficient manner.

According to other method features of the invention, the adapter defines an inner cylindrical cavity axially aligned with the outer cylindrical cavity and a central cavity separating the inner and outer cylindrical cavities and defined by a ridge having an inner annular surface facing the inner cylindrical cavity, and the pressing step comprises moving an end of the outer electrical conductor into the inner cavity and into engagement with the inner annular surface. These steps simplify production of the assembly.

According to still other method features, the inner electrical conductor and the adapter are made of stainless steel and are plated before the pressing step. The use of plated stainless steel facilitates both hermetic sealing and soldering of the inner conductor and adapter while performing the plating step before insertion of the outer conductor reduces plating costs and minimizes the addition of undesirable magnetic properties to the assembly.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
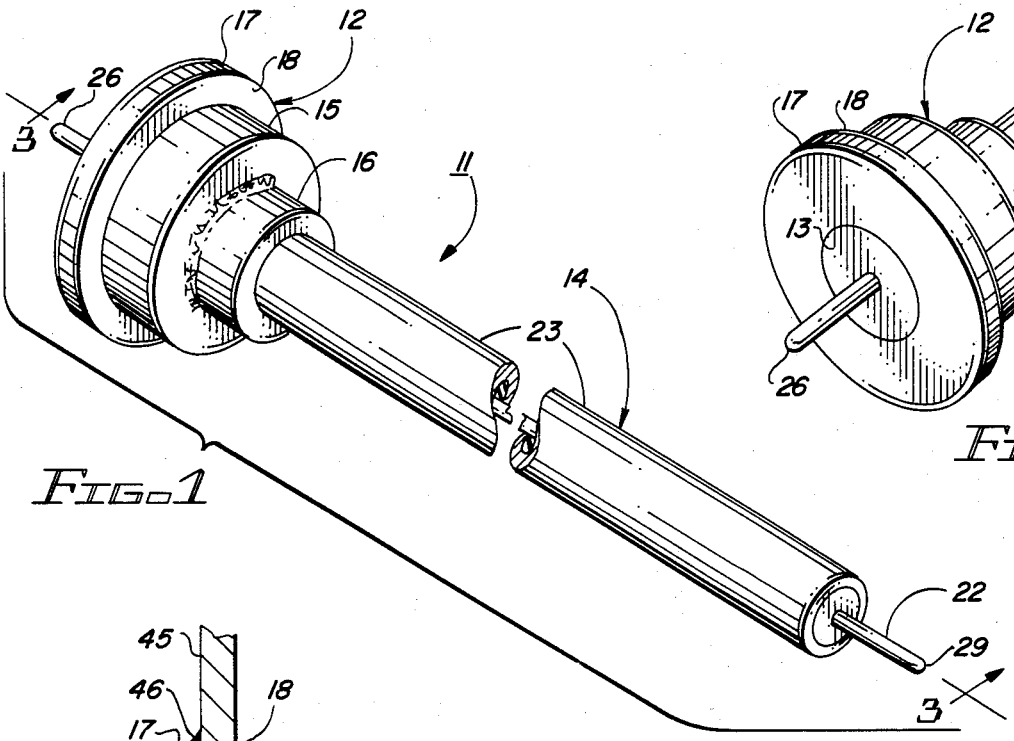
FIG. 1 is a right perspective view of an hermetically sealed electrical feedthrough assembly according to the invention.
Figure 2:
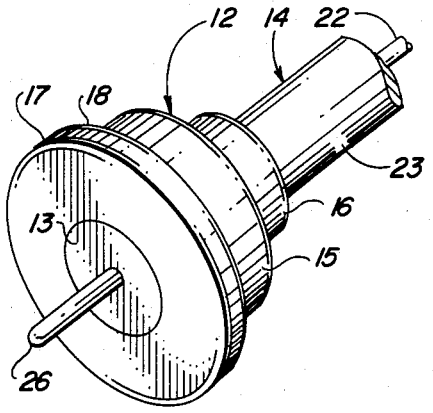
FIG. 2 is a left perspective view of the assembly shown in FIG. 1.
Figure 3:
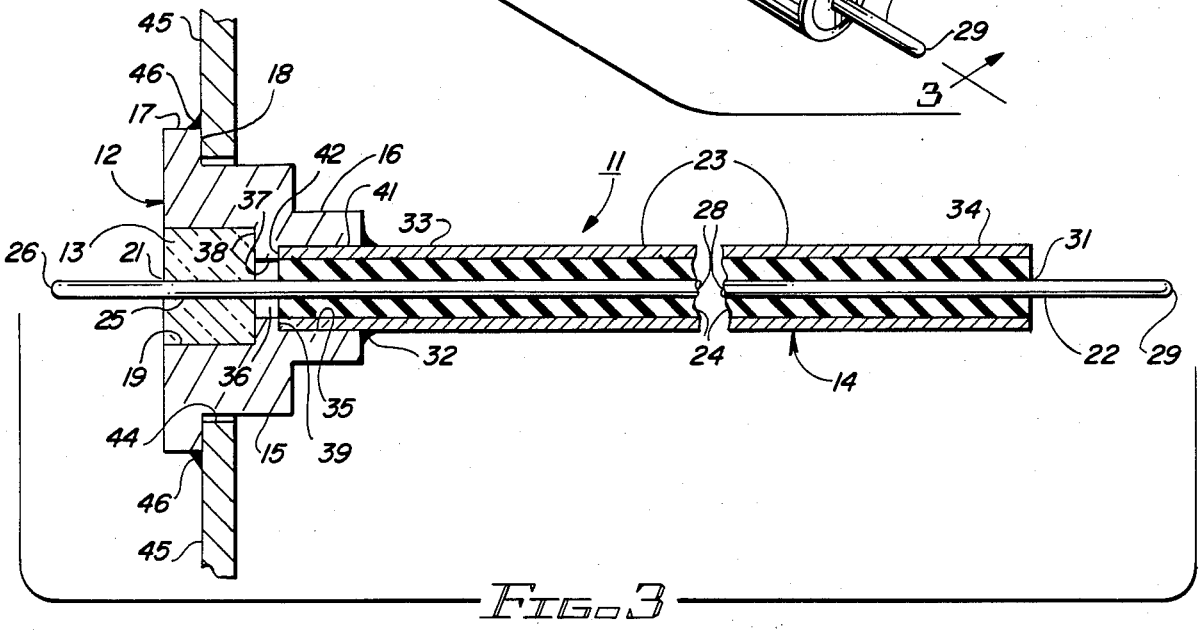
FIG. 3 is a sectional view taken along the lines 3—3 of FIG. 1.
Figure 4:
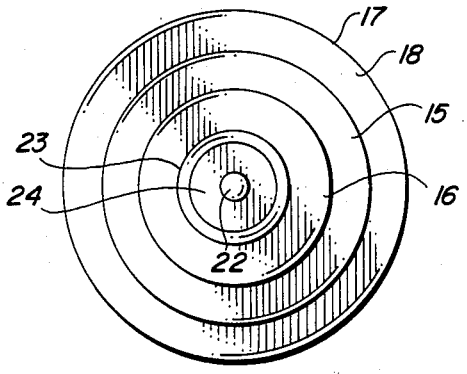
FIG. 4 is a right end view of the assembly shown in FIG. 1.
Figure 5:
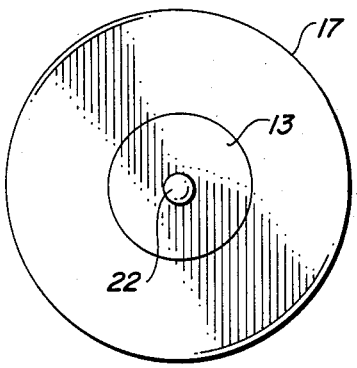
FIG. 5 is a left end view of the assembly shown in FIG. 1.

A preferred embodiment of an electrical feedthrough assembly 11 is illustrated in FIGS. 1–5. Included in the assembly 11 are a metal adapter 12 and a cylindrical glass body 13 and a coaxial cable 14 both retained thereby. The adapter 12 has an outer cylindrical portion 15 joined to an inner cylindrical portion 16 of reduced diameter and both axially aligned with the coaxial cable 14. Projecting outwardly from the outer cylindrical portion 15 is a circumferential flange 17 that defines an annular surface 18 facing toward the coaxial cable 14. Further defined by the outer cylindrical portion 15 is an outer cylindrical cavity 19 that retains and conforms in shape to the glass body 13, which also is axially aligned with the cable 14. The glass body 13 is hermetically sealed within the outer cylindrical cavity 19 of the adapter 12 and defines an axial passage 21.

Forming the coaxial cable 14 is an elongated inner electrical conductor 22 and an elongated and coaxial, tubular outer electrical conductor 23 separated therefrom by an annular space filled with an electrical insulation material 24. One length portion 25 of the inner conductor 22 adjacent to a first end 26 thereof is received by and hermetically sealed in the axial passage 21 of the glass body 13. Another length portion 28 of the inner conductor 22 between a second end 29 thereof and the one length portion 25 is received by a central passage 31 in the electrical insulation 24. Electrically connected to the adapter 12 by solder 32 is one end portion 33 of the outer conductor 23 while an opposite end portion 34 terminates adjacent to the second end 29 of the inner conductor 22.

An inner cylindrical cavity 35 is formed in the reduced diameter inner portion 16 of the adapter 12. The inner cavity 35 is axially aligned with the outer cavity 19 and is separated therefrom by a central cavity 36 defined by an inwardly directed annular rib 37 projecting inwardly from the outer portion 15 of the adapter 12. Defined by the annular rib 37 is an outer shoulder surface 38 engaged by the glass body 13 and an inner shoulder surface 39. An end section 41 of the one end portion 33 of the outer conductor 23 conforms in shape to and is received by the inner cylindrical cavity 35. Engaging the inner shoulder surface 39 of the annular rib 37 is an end 42 of the end section 41.

According to a preferred embodiment of the assembly 11, the adapter 12 and the inner conductor 22 are made of stainless steel plated with a nickel, gold alloy; the outer conductor 23 is made of ductile, electrically conductive material such as copper; and the electrical insulation 24 is a suitable dielectric. In typical use, the outer portion 15 of the adapter 12 is inserted through an opening 44 in a housing 45 to produce engagement thereof with the annular surface 18 on the circumferential flange 17. A hermetic seal then is established between the housing 45 and the adapter 12 by solder 46 applied between the housing 45 and the circumferential flange 17. The second end 29 of the inner conductor 22 and the opposite end portion 34 of the outer conductor 23 then are electrically connected to circuitry (not shown) to be hermetically sealed within the housing 45. A conventional female socket connector then can be coupled to the first end 26 of the inner conductor 22 so as to provide for the transmission of electrical signals through the walls of the housing 45.

In accordance with a preferred method of construction for the assembly 11, the length portion 25 of the inner conductor 22 is inserted into the axial passage 21 of the glass body 13 which then is inserted into the outer cylincrical cavity 19 of the adapter 12. Sequential heating and cooling produces non-uniform expansion of the glass body 13 relative to the stainless steel inner conductor 22 and adapter 12 and resultant compression therebetween that creates an hermetic seal. After the sealing step, the exposed surfaces of the inner conductor 22 and the adapter 12 are plated with a nickel, gold alloy. The gold in the plating finish enhances the electrical conductivity of the inner conductor 22 and the adapter 12 so as to reduce the RF insertion losses of the completed cable assembly 11, while the nickel content both facilitates subsequent soldering operations on the adapter 12 and functions as a barrier to prevent the migration of contaminants through the gold and nickel layer. Next, the previously combined outer conductor 23 and insulation 24 are assembled as a composite body by pressing the length portion 28 of the inner conductor 22 into the central passage 31. During this assembly step, the end section 41 of the outer conductor 23 is inserted into the inner cylindrical cavity 35 of the adapter 12 until the end 42 of the outer conductor 23 engages the inner surface 39 of the rib 37. Finally, the outer conductor 23 is secured to the adapter 12 by the application of solder 32 therebetween.

What is claimed:

1. An hermetically sealed electrical feedthrough assembly comprising:

an elongated substantially non-magnetic inner electrical conductor plated with a solderable material and having first and second ends;

a glass body hermetically sealed around one length portion of said inner conductor adjacent to said first end thereof;

a substantially non-magnetic metal adapter plated with a solderable material and hermetically sealed around said glass body and adapted for mounting in a wall of a housing;

a tubular outer electrical conductor enclosing and coaxial with another length portion of said inner electrical conductor; said outer electrical conductor being separated from said inner electrical conductor by an annular volume and having one end portion electrically connected to said metal adapter and an opposite end portion disposed adjacent to said second end of said inner electrical conductor; and electrical insulation means filling said annular volume and electrically isolating said outer electrical conductor from said another length portion of said inner electrical conductor.

2. An assembly according to claim 1 wherein said adapter includes an outer cylindrical cavity extending inwardly from an outer end thereof and an inner cylindrical cavity extending inwardly from an inner end thereof and coaxially alinged with said outer cylindrical cavity, said outer cylindrical cavity retaining said glass body, and said inner cylindrical cavity retaining an end section of said outer electrical conductor.

3. An assembly according to claim 2 wherein said adapter comprises a circumferential flange with an annular surface for engaging the wall of the housing, said annular surface facing toward said second end.

4. An assembly according to claim 3 wherein said inner and outer cylindrical cavities are separated by a central cavity defined by an annular rib having an inner surface facing said inner cylindrical cavity and an outer surface facing said outer cylindrical cavity, said inner surface engaging said outer electrical conductor, and said outer surface engaging said glass body.

5. An assembly according to claim 4 wherein the diameter of said inner cylindrical cavity is less than the diameter of said outer cylindrical cavity.

6. An assembly according to claim 5 wherein said another length portion of said inner electrical conductor extends between said second end thereof and said central cavity.

7. An assembly according to claim 6 wherein said inner electrical conductor and said adapter are made of stainless steel and said plated solerable material is an alloy comprising nickel and gold.

8. An assembly according to claim 7 wherein said outer electrical conductor is made of a ductile, electrically conductive material.

9. An assembly according to claim 2 wherein said inner and outer cylindrical cavities are separated by a central cavity defined by an annular rib having an inner surface facing said inner cylindrical cavity and an outer surface facing said outer cylindrical cavity, said inner surface engaging said outer electrical conductor, and said outer surface engaging said glass body.

10. An assembly according to claim 9 wherein the diameter of said inner cylindrical cavity is less than the diameter of said outer cylindrical cavity.

11. An assembly according to claim 10 wherein said another length portion of said inner electrical conductor extends between said second end thereof and said central cavity.

12. An assembly according to claim 1 wherein said inner electrical conductor and said adapter are made of stainless steel and said plated solderable material is an alloy comprising nickel and gold.

13. An assembly according to claim 12 wherein said outer electrical conductor is made of a ductile, electrically conductive material.

14. An assembly according to claim 12 wherein said adapter includes an outer cylindrical cavity extending inwardly from an outer end thereof and an inner cylindrical cavity extending inwardly from an inner end thereof and coaxially aligned with said outer cylindrical cavity, said outer cylindrical cavity retaining said glass body, and said inner cylindrical cavity retaining an end section of said outer electrical conductor.

15. A method for producing an hermetically sealed electrical feedthrough assembly and comprising the following steps:

providing a cylindrical glass body with an axial passage;

providing a substantially non-magnetic metal adapter with an outer cylindrical cavity extending inwardly from an outer end thereof and conforming to said glass body;

providing an elongated substantially non-magnetic inner electrical conductor;

providing an elongated, tubular outer electrical conductor having an inner surface engaged by an elongated cylindrical insulator defining a central passage coaxially aligned with said outer electrical conductor and conforming in shape to said inner electrical conductor;

inserting one length portion of said inner electrical conductor into said axial passage;

inserting said glass body into said outer cylindrical cavity;

applying heat so as to produce a hermetic seal between said glass body and both said adapter and said one length portion of said inner electrical conductor;

plating exposed portions of said adapter and said inner electrical conductor with a solderable material;

subsequently pressing another length portion of said inner electrical conductor into said central passage; and electrically connecting said outer electrical conductor to said adapter.

16. A method according to claim 15 wherein said inner electrical conductor and said adapter are made of stainless steel and said step of plating with solderable material comprises plating said adapter and said inner electrical conductor with an alloy comprising nickel and gold.

17. A method according to claim 16 wherein said adapter includes an inner cylindrical cavity extending inwardly from an inner end thereof and axially aligned with said outer cylindrical cavity, and said pressing step includes inserting an end section of said outer electrical conductor into said inner cylindrical cavity.

18. A method according to claim 15 wherein said adapter includes an inner cylindrical cavity axially aligned with said outer cylindrical cavity, and said pressing step includes inserting an end section of said outer electrical conductor into said inner cylindrical cavity.

19. A method according to claim 18 wherein said adapter includes a central cavity separating said inner and outer cylindrical cavities and defined by projection means having an inner surface means facing said inner cylindrical cavity, and said pressing step comprises moving an end of said outer electrical conductor into engagement with said inner surface means.

20. A method according to claim 19 wherein said inner electrical conductor and said adapter are made of stainless steel and said step of plating with solderable material comprises plating said adapter with an alloy comprising nickel and gold.

21. An hermetically sealed electrical feedthrough assembly comprising:

an elongated inner electrical conductor having first and second ends;

a glass body hermetically sealed around one length portion of said inner conductor adjacent to said first end thereof;

a metal adapter hermetically sealed around said glass body and adapted for mounting in a wall of a housing; said adapter defining an outer cylindrical cavity extending inwardly from an outer end thereof and an inner cylindrical cavity extending inwardly from an inner end thereof and coaxially aligned with said outer cylindrical cavity, said outer cylindrical cavity retaining said glass body; said inner and outer cylindrical cavities being separated by a central cavity defined by projection means having inner surface means facing said inner cylindrical cavity and outer surface means facing said outer cylindrical cavity, said outer surface means engaging said glass body;

a tubular outer electrical conductor enclosing and coaxial with another length portion of said inner electrical conductor; said outer electrical conductor being separated from said inner electrical conductor by an annular volume and having one end portion extending into said inner cylindrical cavity and abutting said inner surface means of said projection and being electrically connected to said metal adapter, and an opposite end portion disposed adjacent to said second end of said inner electrical conductor; and electrical insulation means filling said annular volume and electrically isolating said outer electrical conductor from said another length portion of said inner electrical conductor.

22. An assembly according to claim 21 wherein said adapter is one-piece and comprises a circumferential flange with an annular surface for engaging the wall of the housing, said annular surface facing toward said second end.

23. An assembly according to claim 21 wherein the diameter of said inner cylindrical cavity is less than the diameter of said outer cylindrical cavity.

24. An assembly according to claim 23 wherein said another length portion of said inner electrical conductor extends between said second end thereof and said central cavity.

25. An assembly according to claim 21 wherein said projection means comprises an annular rib disposed between said inner and outer cylindrical cavities.

26. An hermetically sealed electrical feedthrough assembly comprising:

an elongated inner electrical conductor having first and second ends;

a glass body hermetically sealed around one length portion of said inner conductor adjacent to said first end thereof;

a one-piece metal adapter hermetically sealed around said glass body and adapted for mounting in a wall of a housing, said adapter including a circumferential flange with an annular surface for engaging the wall of the housing, said annular surface facing toward said second end;

a tubular outer electrical conductor enclosing and coaxial with another length portion of said inner electrical conductor, said outer electrical conductor being separated from said inner electrical conductor by an annular volume and having one end portion electrically connected to said metal adapter and an opposite end portion disposed adjacent to said second end of said inner electrical conductor; and electrical insulation means filling said annular volume and electrically isolating said outer electrical conductor from said another length portion of said inner electrical conductor.

* * * * *